United States Patent [19]

Shiokawa

[11] Patent Number: 4,652,753

[45] Date of Patent: Mar. 24, 1987

[54] MASS SPECTROMETER CAPABLE OF ANALYZING AN INSULATOR

[75] Inventor: Yoshiro Shiokawa, Tokyo, Japan

[73] Assignee: Anelva Corporation, Japan

[21] Appl. No.: 684,602

[22] Filed: Dec. 21, 1984

[30] Foreign Application Priority Data

Dec. 26, 1983 [JP] Japan ..... 58-247537

[51] Int. Cl.[4] ..... H01J 49/42; H01J 49/48

[52] U.S. Cl. ..... 250/281; 250/292; 250/305

[58] Field of Search ..... 250/281, 282, 290, 292, 250/293, 294, 296, 309, 305

[56] References Cited

U.S. PATENT DOCUMENTS 3,665,185 5/1972 Goff ..... 250/282
4,058,724 11/1977 McKinney et al. ..... 250/309
4,097,738 6/1978 Feve et al. ..... 250/305

FOREIGN PATENT DOCUMENTS 0114765 8/1984 European Pat. Off. ..... 250/305

OTHER PUBLICATIONS

Werner et al., Charging of Insulators by Ion Bombardment and its Minimization for Secondary Ion Mass Spectrometry (SIMS) Measurements, J. App. Phys. (1976).

Jones, An Apparatus for Determining the Secondary Electron Emission Properties of Nonconductors, J. Phys. E., vol. 3 (Dec. 1970).

Medley, Energetic Ion Mass Analysis Using a Radio-Frequency Quadrupole Filter, Rev. Sci. Lust, 49(6), (Jun. 1978).

Nakamura et al., Surface Observation of Insulating Materials with Low Microprobe Analyzer, Proc. 6th Intl. Vac. Cong. (1974).

Leys et al., Surface Analysis in a SEM with SIMS Imaging, Scan Elec. Micr. (Apr. 1976).

*Primary Examiner*—Bruce C. Anderson
*Assistant Examiner*—Paul A. Guss
*Attorney, Agent, or Firm*—Laff, Whitesel, Conte & Saret

[57] ABSTRACT

In a mass spectrometer comprising an ion gun for radiating an ion beam onto a surface of an object to make the surface emit secondary ions, a detector for the secondary ions, and a directing member for directing the secondary ions to the detector, a specific energy bandwidth is defined in an energy distribution of the secondary ions in consideration of a peak of the energy distribution. An analyzable energy range is expanded to at least twice the specific energy bandwidth by the use of an expanding member coupled to the directing member. The expanding member may be used to expand a transmissible bandwidth of an energy filter included in the directing member by raising a resolution and a center transmission energy. The expanding member may be used to raise a maximum analyzable energy of a quadrupole mass filter included in the mass filter. Specifically, the expanding member may be implemented by changing a length of each electrode member of the mass filter and/or a frequency of an a.c. voltage supplied to each electrode member.

12 Claims, 7 Drawing Figures

MASS SPECTROMETER CAPABLE OF ANALYZING AN INSULATOR

BACKGROUND OF THE INVENTION

This invention relates to a mass spectrometer in which secondary ions can be used to analyze insulators.

A mass spectrometer comprises an ion gun for radiating an ion beam onto a surface of an object to make the surface emit secondary ions having an energy distribution. The secondary ions' energy distribution has a peak and a "specific energy bandwidth" defined with reference to the peak in a manner which will later be described more in detail.

The mass spectrometer further comprises a detector for ions and a directing member for directing secondary ions having energies coming within an analyzable energy range of the mass spectrometer to the detector. In a conventional mass spectrometer, its analyzable energy range has a width nearly equal to the specific energy bandwidth of the secondary ions. However, with this structure it is difficult to analyze an insulator, although a conductor can be analyzed. This is because for an insulator the energy distribution of the secondary ions becomes inconveniently shifted, as will be explained below.

SUMMARY OF THE INVENTION

It is an object of this invention to provide a mass spectrometer which is capable of analyzing an insulator as well as a conductor.

A mass spectrometer to which this invention is applicable comprises an ion gun for radiating an ion beam onto a surface of an object to make the surface emit secondary ions having an energy distribution, a detector for the ions, and directing means for directing the secondary ions having energies coming within an analyzable energy range of the mass spectrometer to said detector. The secondary ions' energy distribution has a peak and a "specific energy bandwidth" defined with reference to the peak. The mass spectrometer's analyzable energy range is predetermined in consideration of the secondary ions' specific energy bandwidth. According to this invention, to accommodate analysis of insulators, the mass spectrometer comprises expanding means coupled to its directing means for expanding the mass spectrometer's analyzable energy range to a wider range. The wider range is equal to at least twice the secondary ions' specific energy bandwidth.

DESCRIPTION OF THE PREFERRED EMBODIMENTS

Figure 1:
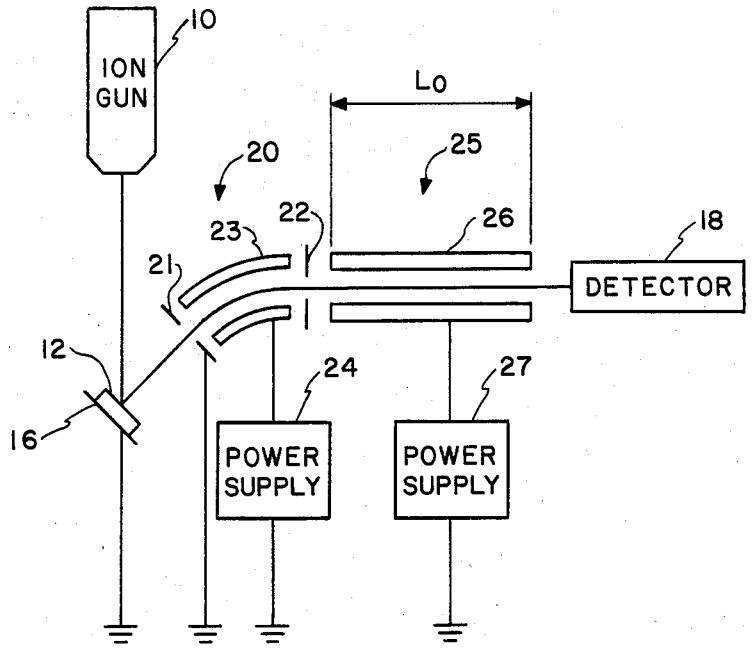
FIG. 1 PRIOR ART
FIG. 1 is a block diagram of a conventional mass spectrometer comprising a directing member schematically depicted in an axial section.

Referring to FIG. 1, a conventional mass spectrometer will be described at first for a better understanding of this invention. The mass spectrometer comprises an ion gun 10 for radiating an ion beam onto a surface of an object 12 to make the object's surface emit secondary ions having a characteristic energy distribution. The analyzed object is held by a holder 16 kept at the ground potential.

Figure 2:
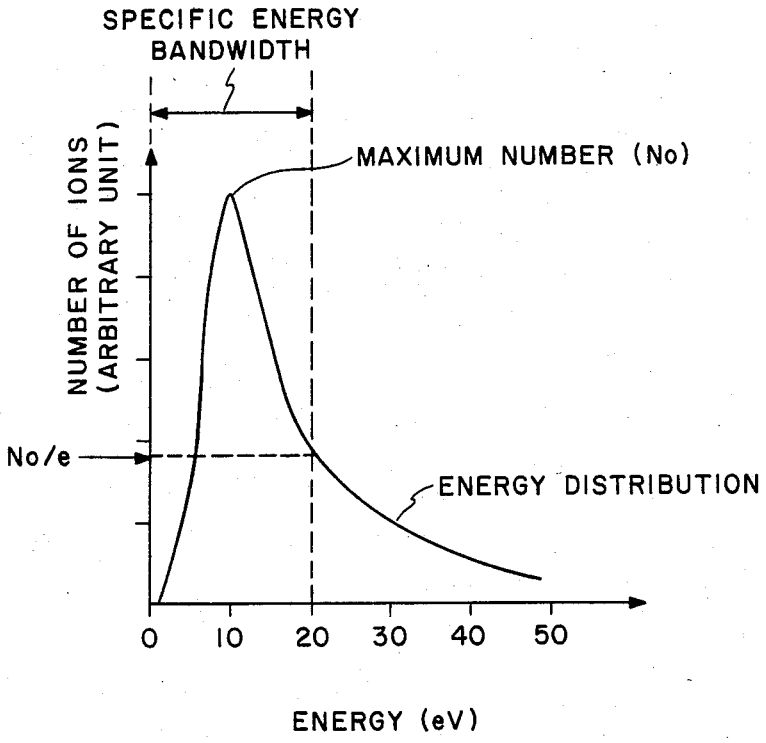
FIG. 2 PRIOR ART
FIG. 2 shows an energy distribution of secondary ions and a "specific energy bandwidth" defined with reference to it.

Referring to FIG. 2, a typical energy distribution for the secondary ions is shown. The abscissa and the ordinate respectively represent energy (eV) and the relative number of ions (arbitrary unit). The energy distribution of the secondary ions has a peak, namely, a maximum number $N_0$, at about 10 eV and is typically spread between zero and several tens of electron volts. In order to characterize the secondary ions' energy distribution, let a "specific energy bandwidth" be defined as the difference between zero energy and the energy value above the distribution's peak at which the relative number of ions has fallen to the maximum number $N_0$ divided by a constant e, the base of the natural logarithm, equal to about 2.71828. According to the inventor's experimental studies, it has been found out that the specific energy bandwidth is different for every material analyzed by the mass spectrometer. However, it is narrower than or equal to 20 eV for all of the materials, as shown in FIG. 2. This suggests that a mass spectrometer can be very useful if it has an analyzable energy range of width substantially equal to the secondary ions' specific energy bandwidth. Practically, the analyzable energy range of the conventional mass spectrometer is usually equal to about 20 eV. The mass spectrometer's analyzable energy range is determined in a manner to be described later.

The mass spectrometer further comprises a detector 18 for ions and a directing member for directing the secondary ions having energies coming within the spectrometer's analyzable energy range to the detector 18. The directing member typically comprises an electrostatic deflection type energy filter 20 for filtering out all but secondary ions having energies within a transmission band, the ions passing through the filter being called "transmitted ions." The transmission band has a center energy which may be called its transmission energy and an energy bandwidth called its transmission bandwidth. It is known in the art that such an electrostatic deflection energy filter 20 has a certain resolution which is related to its transmission bandwidth and transmission energy. The transmission bandwidth of the energy filter is given by a product of the resolution and the transmission energy. Therefore, for a typical resolution of 0.5 the transmission bandwidth is equal to 5 eV when the transmission energy is 10 eV. The 5 eV wide transmission band lies between 7.5 and 12.5 eV. Likewise, the transmission bandwidth becomes 10 eV for a 0.5 resolution energy filter having a center or transmission energy of 20 eV; the transmission band then lies in a transmission band between 15 and 25 eV. Under the circumstances, most of conventional energy filters have a transmission bandwidth of between 5 and 20 eV.

In addition, the energy filter 20 may be of any electrostatic deflection type, for example, a cylindrical or hemispherical type. It typically comprises an entrance electrode 21 defining an entrance slit, an exit member 22 defining an exit slit, a pair of arcuate deflecting plates 23, and a controllable power supply 24. The arcuate deflecting plates 23 are spaced apart from each other with a curved space left therebetween. The space is extended between the entrance and the exit slits and defines an ion orbiting path for guiding the secondary ions. It is possible to keep the ion orbiting path at a predetermined electric potential by controlling a source voltage of the controllable power source 24. In the example being illustrated, the predetermined electric potential of the ion orbiting path is kept equal to the ground potential.

In the manner known in the art, the resolution of the energy filter 20 can be adjusted by varying the distance between the arcuate deflecting plates 23 and the size of the exit slit.

The energy filter 20 is followed by a quadrupole mass spectrometer or mass filter 25 which is operable as part of the directing member and which has a "maximum analyzable energy" value for the ions it can analyze. The secondary ions supplied to the quadrupole mass filter 25 are those passing through the energy filter 20 as transmitted ions. The quadrupole mass filter 25 can carry out a mass analysis of the transmitted ions having energies coming within a range which is between 0 energy and its maximum analyzable energy value. This range of ion energies permitting mass analysis may be called a mass analyzable band.

More specifically, the quadrupole mass filter 25 has a center axis for guiding the transmitted ions. Four electrodes 26 are azimuthally spaced apart from one another concentrically around the center axis and extend along the center axis between the energy filter 20 and the detector 18 with a length $L_0$. A controllable power supply 27 is for supplying each electrode 26 with a superposition of a d.c. voltage and an a.c. voltage of frequency $f_0$ in a well known manner. The mass filter's center axis is kept at a center potential. The controllable power supply 27 is set so that the center potential is equal to the holder electric potential, which is typically ground.

The mass filter's maximum analyzable energy value is dependent on the mass filter's electrode length $L_0$ and the frequency of $f_0$ of applied electrode voltage and is selected at 20 eV or so in the illustrated quadrupole mass filter 25. In this case, the length $L_0$ and the frequency $f_0$ are typically equal to 0.2 m and 1.8 MHz, respectively. At any rate, the maximum energy value and the mass analyzable band are related to the transmissible bandwidth and the transmissible band of the energy filter 20. In the example being illustrated, the mass analyzable band is substantially equal to the specific energy bandwidth.

With this structure, the object 12 is grounded through the holder 16. A surface electric potential of the object 12 is therefore kept at the ground potential when the object 12 is a conductor. The secondary ions can be favorably analyzed with the conventional mass spectrometer so long as the surface electric potential is kept at the ground potential. This implies that a favorable analysis of a conductor is possible with the conventional mass spectrometer. On the other hand, the surface electric potential of the object 12 irregularly fluctuates or varies to a positive value or a negative one due to accumulation of charges resulting from the ions emitted from the ion gun 10 when the object 12 is an insulator. As a result, the secondary ions are emitted from the object 12 of the insulator with an energy value which is equal to a sum of potential energy decided by the surface electric potential and kinetic energy of the secondary ions. Thus, the energy distribution is shifted on analysis of the insulator in accordance with fluctuation of the surface electric potential.

The direction of the shift of the energy distribution is determined by the polarity of the ions bombarded onto the surface of the object 12. In order to avoid such shift of energy distribution, attempts have been made so as to neutralize or cancel the charges of the ion beam on the surface of the object 12 by emission of ions carrying charged particles which are oppositely charged relative to those of the bombarded ions. Such ions of the oppositely charged particles are superposed on the ion beam on the surface of the object 12.

However, the attempts are not always useful because it is difficult to control the surface electric potential and to keep a state of equilibrium so that the surface electric potential becomes equal to the ground potential. At any rate, the conventional mass spectrometer is not suitable for analysis of an insulator.

First Embodiment

Figure 3:
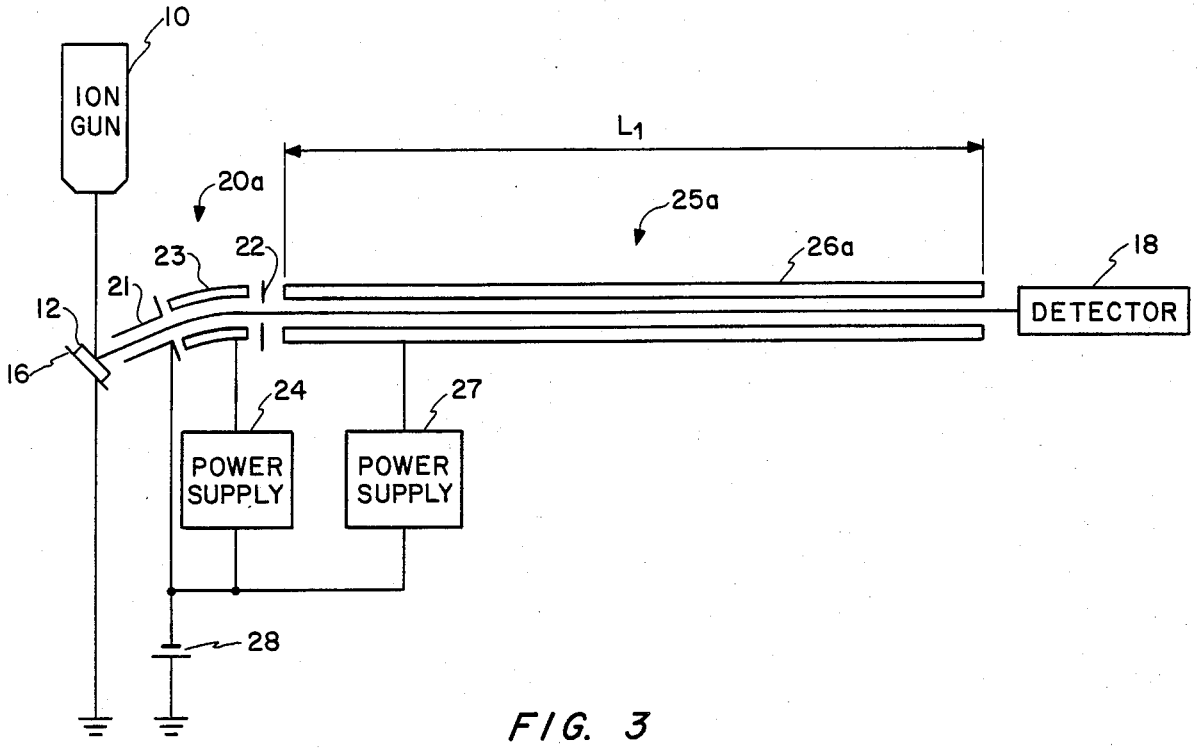
FIG. 3 is a block diagram, similar to FIG. 1, of a mass spectrometer according to a first embodiment of this invention.

Referring to FIG. 3, a mass spectrometer according to a first embodiment of this invention is similar to that illustrated in FIG. 1 except that the energy filter and the quadrupole mass filter are improved in FIG. 3 to expand the analyzable energy range as will later become clear and are therefore depicted at 20*a* and 25*a*, respectively. The analyzable energy range is widened in the illustrated mass spectrometer so that a plurality of the specific energy bandwidths are included in the analyzable energy range.

As mentioned before, the energy distribution of the secondary ions is shifted as a result of fluctuation of the surface electric potential of the object 12. According to the inventor's experimental studies, the shift of the secondary ions' energy distribution in electron volts (eV) can be restricted to an energy shift range between minus 100 eV and plus 100 eV. This means that the analyzed object's surface electric potential can vary between minus 100 volts and plus 100 volts relative to holder 16's potential, which is typically kept at ground potential. Therefore, analysis will be possible as regards the secondary ions resulting from most insulators if the mass spectrometer's analyzable energy range can be expanded to cover between +100 eV and −100 eV.

The reason why the energy shift range of the secondary ions can be restricted between +/−100 eV will now be explained. At first, the ion gun 10 (FIG. 3) emits the bombarding ions, namely the ion beam, with an ion irradiation voltage $V_p$ impressed on them. The ion irradiation voltage $V_p$ may also be called an "accelerating voltage", as it is in FIG. 4. The analyzed object's surface electric potential is variable and builds up due to the bomdarding ions as mentioned before, but cannot be expected to exceed the accelerating or ion irradiation voltage $V_p$ of the ion gun 10. Therefore, the surface electric potential will be found between zero and $(V_p-\alpha)$ volts, where the empirical $\alpha$ takes a value between several volts and several tens of volts. It follows that lowering the ion irradiation or accelerating voltage $V_p$ narrows the range of energy shift.

Figure 4:
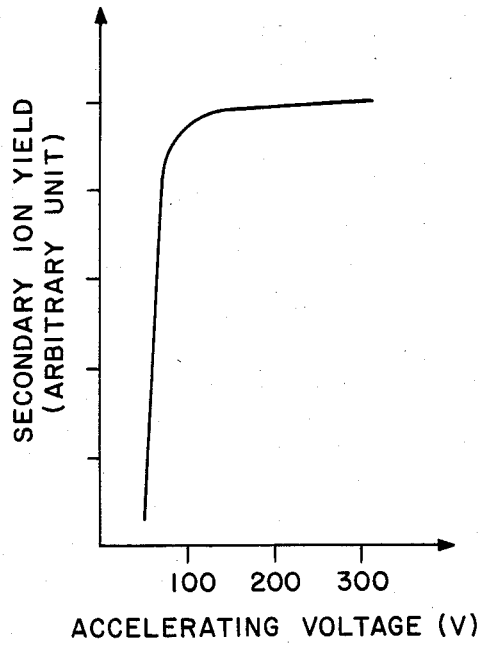
FIG. 4 shows that secondary ion yield depends on an ion radiating voltage.

However, FIG. 4 shows that the yield of secondary ions depends on the ion beam acceleration voltage. If the ion beam accelerating voltage $V_p$ becomes lower than 100 volts, the secondary ions produced by the ion gun 10 have a yield which is drastically reduced. Accordingly, it is impractical to render the ion beam accelerating voltage $V_p$ lower than 100 volts in view of the need for a good yield of secondary ions.

Moreover, at least one hundred volts should be impressed to put the ion gun 10 into normal operation. Therefore, suppose the ion beam accelerating voltage $V_p$ is adjusted for $(100+\alpha)$ volts, a value that will lie somewhere between 100 and 150 volts. In such a case the analyzed object's surface potential will range between 0 and $(V_p-\alpha)=(100+\alpha-\alpha)=100$ volts. So, if we make allowance for beams of either polarity, the object's surface electric potential can always be kept between 0 and $+/-100$ volts.

Even when the ion irradiation voltage $V_p$ is further increased so as to sharpen the ion beam, the surface electric potential can be restricted between 0 and $+100$ volts and between 0 and $-100$ volts by neutralizing the charges resulting from the ion beam in the known manner. For neutralization of the ion beam, neutralization ions are bombarded onto the surface of the object 12 with a polarity inverse to that of the ion beam. The surface electric potential should alway fall within a potential range between 0 and $+100$ volts and between 0 and $-100$ volts when the neutralization ions are greater in quantity than the irradiation ions and have an irradiation voltage reduced to near the 100 volts.

Thus, it is readily possible to restrict the surface electric potential to the above-mentioned potential range. Therefore, most insulators can be analyzed if the mass spectrometer is improved to give it an analyzable energy range between minus 100 eV and plus 100 eV.

In contrast to a 0.5 resolution for the prior art energy filter of FIG. 1, the energy filter 20*a* of FIG. 3 has a resolution expanded to about 1. It is known in the art that such an expansion of resolution is possible by widening the exit slit of the exit slit member 22 and/or by controlling the distance between the arcuate deflecting plates 23 and the curvature of each deflecting plate 23. As described in conjunction with FIG. 1, the transmission bandwidth of the energy filter 20*a* is given by the product of the transmission energy and the resolution.

In order to expand the energy filter's transmission bandwidth, let its center or transmission energy be selected at 200 eV. In this event, because of the 1.0 resolution, the filter's transmission bandwidth also becomes 200 eV and the transmission band lies between 100 and 300 eV. To accelerate the secondary ions into this range, a d.c. supply 28 is connected to the entrance electrode 21 and coupled to the deflecting plates 23 through the power supply 24. Also, the entrance electrode 21 is extended to near the surface of the object 12. The power supplies keep the entrance electrode 21 and the ion orbiting path along the center line between the deflecting plates 23 at an electric potential which has a polarity inverse to that of the secondary ions and is lower than the ground potential by about 200 volts. As a result, the secondary ions are drawn from the analyzed object 12 and accelerated to the mass filter 25*a* with an additional 200 eV of energy through entrance electrode 21, the deflecting plates 23, and the exit slit member 22.

FIG. 3's improved quadrupole mass filter 25*a* comprises four electrode members 26*a*, each of which has a length $L_1$ equal to four times the length $L_0$ of the conventional electrodes 26 illustrated in FIG. 1. Each electrode member 26*a* is axially equally divisible into four shorter partial electrode, or subelectrode, members (not shown in detail). One partial electrode member of each member 26*a* is nearest to the energy filter 20*a* and similar to the electrodes 26 (FIG. 1) and the remaining ones of which are contiguous to the nearest partial electrode member and may be called an extension of the nearest partial electrode member. Each electrode member 26*a* is supplied with superposition of the d.c. voltage and the a.c. voltage of the frequency f which are given from the power supply 27, respectively.

With this structure, it is possible to widen the mass analyzable range because the maximum value of an analyzable energy is proportional to a product P of a square of the length $L_1$ of each electrode member 26*a* and a square of the frequency f. More particularly, the product P is given by:

$$P=L^2 \cdot f^2, \quad (1)$$

where L and f are represented by meter and megahertz, respectively.

The length L and the frequency f are selected so that the product P becomes equal to 2.0. As a result, the illustrated quadrupole mass filter 25*a* has the maximum value which is equal to about sixteen times that of the quadrupole mass filter 25 illustrated in FIG. 1 when the same frequency f is used in both the quadrupole mass filters 25 and 25*a*. Inasmuch as the maximum value of the conventional quadrupole mass filter 25 is about 20 eV, the illustrated mass filter 25*a* has the maximum value of about 300 eV.

As shown in FIG. 3, the mass filter 25*a* has an ion orbiting path along the axis thereof. The ion orbiting path is kept at a path potential which is lower than the ground potential by 200 volts by connection of the d.c. supply 28.

In operation, the object 12 is laid on the holder 16 kept at the ground potential. Let the surface electric potential of the object 12 be kept at the ground potential with the power supplies 24, 27, and 28 connected in the illustrated manner. The secondary ions emitted from the object 12 are drawn by the entrance electrode 12 with the potential energy of 200 eV added to the secondary ions. As a result, the secondary ions of about 200 eV pass through the energy filter 20*a* and are introduced into the detector 18 through the mass filter 26*a*.

Let the surface electric potential of the object 12 be either minus 100 volts or plus 100 volts. In this event, the secondary ions have energy of 300 eV and 100 eV, respectively, which falls within the transmissible bandwidth and the mass analyzable range of the energy filter 20*a* and the mass filter 25*a*, because the transmissible bandwidth is equal to the band of 200 eV between 100 and 300 eV and the mass analyzable range is between 0 and 300 eV. Anyway, the illustrated mass spectrometer has the analyzable energy range between minus 100 eV and plus 100 eV.

Figure 5:
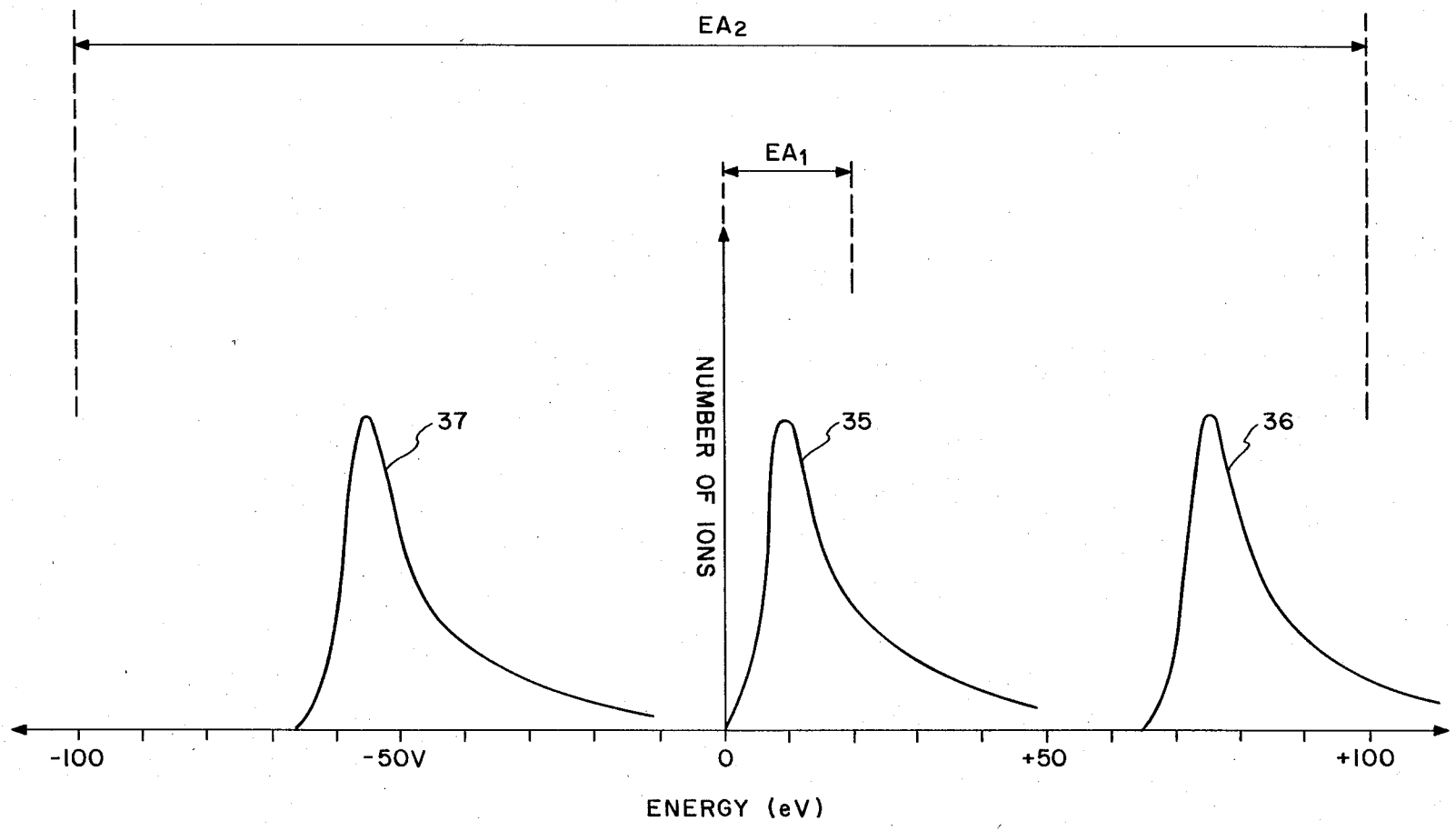
FIG. 5 shows secondary ion energy distributions for use in describing the operation of the mass spectrometers illustrated in FIGS. 1 and 3.

Referring to FIG. 5, comparison of the analyzable energy ranges is made between the conventional mass spectrometer illustrated in FIG. 1 and the mass spectrometer illustrated in FIG. 3. The conventional mass spectrometer has an analyzable energy range $EA_1$ that is about 20 eV in width. This first or conventional analyzable energy range $EA_1$ is substantially equal to the secondary ions' specific energy bandwidth.

On the other hand, the secondary ions have a total energy distribution as indicated at a curve 35 in FIG. 5 when the surface electric potential of the analyzed object 12 can be kept at the ground potential. The conventional mass spectrometer can therefore analyze the secondary ions as long as the analyzed object's surface electric potential is kept at the ground potential.

When the analyzed object's surface electric potential rises to plus 65 volts, the secondary ions exhibit another, shifted total energy distribution indicated by another curve 36. Likewise, the secondary ions show still another energy distribution indicated at 37 when the analyzed object's surface electric potential decreases to minus 65 volts. Under these circumstances, it is readily understood that the secondary ions' total energy distributions indicated at the curves 36 and 37 have shifted outside of the conventional mass spectrometer's analyzable energy range $EA_1$. Accordingly, the conventional mass spectrometer cannot analyze the secondary ion energy distributions indicated by the curves 36 and 37.

The mass spectrometer according to the invention illustrated in FIG. 3 has a second or improved analyzable energy range $EA_2$ between minus 100 eV and plus 100 eV, relative to grounded holder 16. The second analyzable energy range $EA_2$ has a 200 eV bandwidth and therefore includes ten times the specific energy bandwidth of the secondary ions. It is substantially equal to ten times the first analyzable energy range $EA_1$. Therefore, the improved mass spectrometer can analyze the secondary ions even when their total energy distributions are varied by shifting as shown at the curves 36 and 37.

In general, the mass spectrometer's analyzable energy range should preferably cover at least two of the secondary ion's specific energy bandwidths. Various kinds of insulators can be analyzed even when only two specific energy bandwidths of the secondary ions are included in the spectrometer's analyzable energy range. Inclusion of three specific energy bandwidths of the secondary ions in the spectrometer's analyzable energy range enables analysis of a greater variety of insulators. Practically, no problem takes place for insulators when the spectrometer's analyable energy range covers five or more specific energy bandwidths of the secondary ions. The number of secondary ion specific energy bandwidths covered by the mass spectrometer's expanded analyzable energy range need not always be an integral number.

From the above, it is readily understood that the spectrometer's analyzable energy range is preferably of a bandwidth at least one-fifth of the 200 eV wide second analyzable energy range $EA_2$ illustrated in FIG. 5, in order to effectively analyze the secondary ions. Since the energy bandwidth of $EA_2$ is 200 eV, the mass spectrometer's analyzable energy range is preferably of an energy bandwidth at least 40 eV. For an analyzable energy range of the spectrometer which is of a width equal to or wider than one-fifth of the second energy analyzable range $EA_2$, each constant proportional to the bandwidth, such as the product P, should correspondingly be equal to or greater than one-fifth of the corresponding constants in the embodiment of FIG. 3. For example, the transmission bandwidth of the energy filter 20*a*'s transmission band should be equal to or wider than 40 eV. As discussed above, for a 1.0 resolution, a 40 eV bandwidth energy filter would have a 40 eV center or transmission energy, and therefore a transmission band from 20 eV to 60 eV, relative to its ion orbiting path potential. The maximum analyzable energy value of the mass filter 25*a* must then be equal to or greater than 60 eV, relative to its center path potential. The product P should be equal to or greater than 0.4. Differences between the electric potential of holder 16 and the electric potential on the ion orbiting path defined in the energy filter 20*a*, and between the holder electric potential and the center electric potential of the mass filter 25*a*, should then be equal to or greater than 40 volts. In addition, since holder 16 is kept at ground potential, the center electric potential of the mass filter and the ground potential will have a potential difference which is equal to or greater than 40 volts.

The above-mentioned constants are readily realized in the manner described in conjunction with the embodiment of FIG. 3.

Second Embodiment

Figure 6:
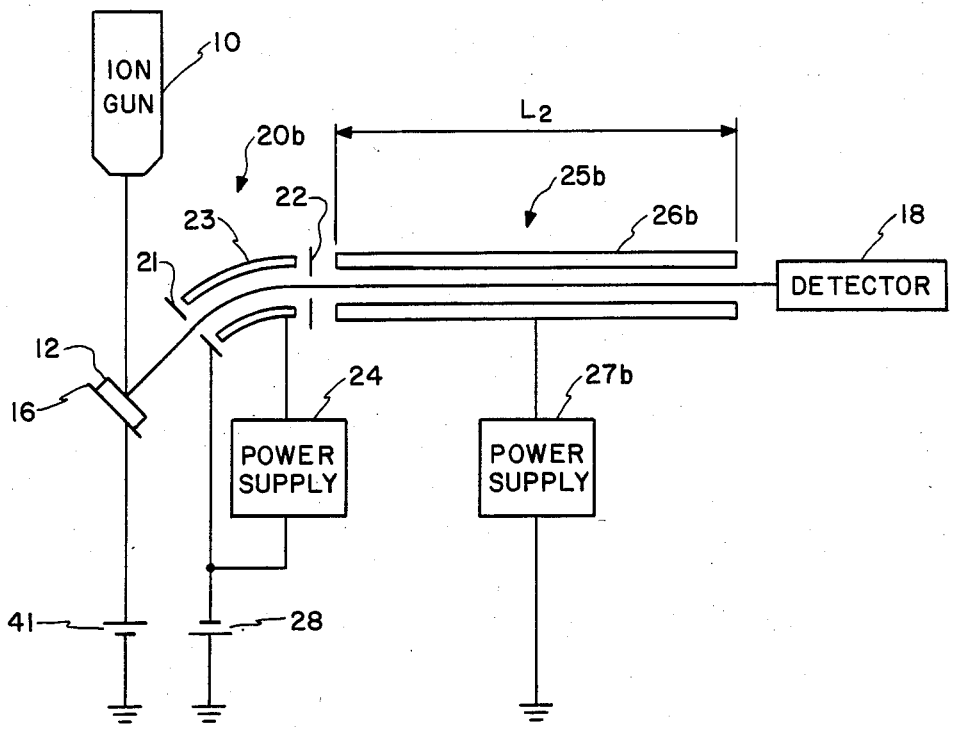
FIG. 6 is a block diagram, like FIG. 3, of a mass spectrometer according to a second embodiment of this invention.

Referring to FIG. 6, a mass spectrometer according to a second embodiment of this invention is similar to that illustrated in FIG. 3 except that the energy filter and the mass filter (indicated at 20*b* and 25*b*) are modified from those illustrated in FIG. 3 and that an addition d.c. supply 41 is connected to the holder 16. The mass spectrometer has an analyzable energy range relative to the potential of holder 16 similar to that illustrated in FIG. 3. Therefore, the analyzable energy range is between −100 eV and +100 eV.

However, the illustrated energy filter 20*b* has a resolution of about 0.5 like the conventional energy filter 20 illustrated in FIG. 1. Its transmission energy is selected at 400 eV. As a result, its transmission bandwidth is equal to 200 eV and the transmission band is laid between 300 and 500 eV. The ion orbiting path of the energy filter 20*b* has an electric potential which is rendered about 200 volts lower relative to the ground potential. To this end, the d.c. supply 28 is connected to the entrance electrode 21 directly and to the deflecting plates 23 through the power supply 24, like in FIG. 3. In addition, the holder 16 is kept at a holder electric potential which is higher than the ground potential by about 200 volts. The holder electric potential has a polarity which is inverse relative to that of the electric potential on the ion orbiting path of the energy filter 20*b*.

The illustrated quadrupole mass filter 25*b* comprises four electrode members indicated at 26*b*. Each electrode member 26*b* has a length $L_2$ equal to twice the length $L_0$ of each electrode 26 (FIG. 1) and is supplied with an a.c. voltage of a frequency which is equal to twice the frequency supplied to each electrode 26 (FIG. 1). As readily understood from Equation (1), the analyzable maximum energy of the illustrated mass filter 25*b* is equal to sixteen times that of the conventional mass filter 25 (FIG. 1) and becomes about 300 eV like the mass filter 25*a* illustrated in FIG. 3.

In addition, the mass filter 25*b* defines an ion orbiting path axially extended at a center portion thereof. A center electric potential of the center portion is kept at the ground potential by a control power supply 27 similar to that illustrated in FIG. 1.

At first, it will be assumed that a potential difference between the surface electric potential of the object 12 and the holder electric potential is equal to zero before bombardment of the ion beam. When the ion beam reaches the surface of the object 12, the secondary ions are emitted from the surface of the object 12. Inasmuch as a difference between the holder and the entrance electric potentials is about 400 volts, the secondary ions pass through the energy filter 20b with an energy value of about 400 eV.

The secondary ions are led into the mass filter 25b having the center portion kept at the ground potential. In the mass filter 25b, the secondary ions are given a reduced energy value of about 200 eV and are decelerated in speed. In general, deceleration of the secondary ions results in divergence of the ion beam. However, such divergence of the secondary ions can become minumum because the mass filter 25b per se is capable of focusing the secondary ions. Therefore, it is possible to avoid the adverse influence resulting from the divergence of the secondary ions.

It will now be assumed that the surface electric potential becomes +100 volts or −100 volts. The secondary ions have energy of 500 eV and 300 eV when the surface electric potential is +100 volts and −100 volts, respectively. The secondary ions of 500 eV and 300 eV are subjected in the mass filter 25b to deceleration to have energy of 300 eV and 100 eV, respectively. As a result, the illustrated mass spectrometer can analyze the secondary ions without any trouble.

In the example being illustrated, the transmissible band of the energy filter 20b is between 300 and 500 eV while the mass analyzable range of the mass filter 25b is between 100 and 300 eV. Thus, the transmissible band may be different from the mass analyzable range because the energy of the secondary ions is adjustable in the mass filter 25b. Anyway, the analyzable energy range of the mass spectrometer is related to the transmissible bandwidth and the mass analyzable range.

The mass spectrometer according to this invention can analyze not only a metal and a semiconductor of a low resistance but also insulators, such as a semiconductor with a high resistance, a glass, ceramics, a macromolecular material, a rock, and an organism. In addition, it is possible to carry out an accurate quantitative analysis even when the energy distribution of the secondary ions is shifted. With an increase of the electric potential given on the entrance electrode 21, an effective detection angle becomes large on mass analysis and a quantity of the secondary ions increases. Accordingly, a precise analysis is possible when the entrance electrode 21 is supplied with a high voltage.

Third Embodiment

Figure 7:
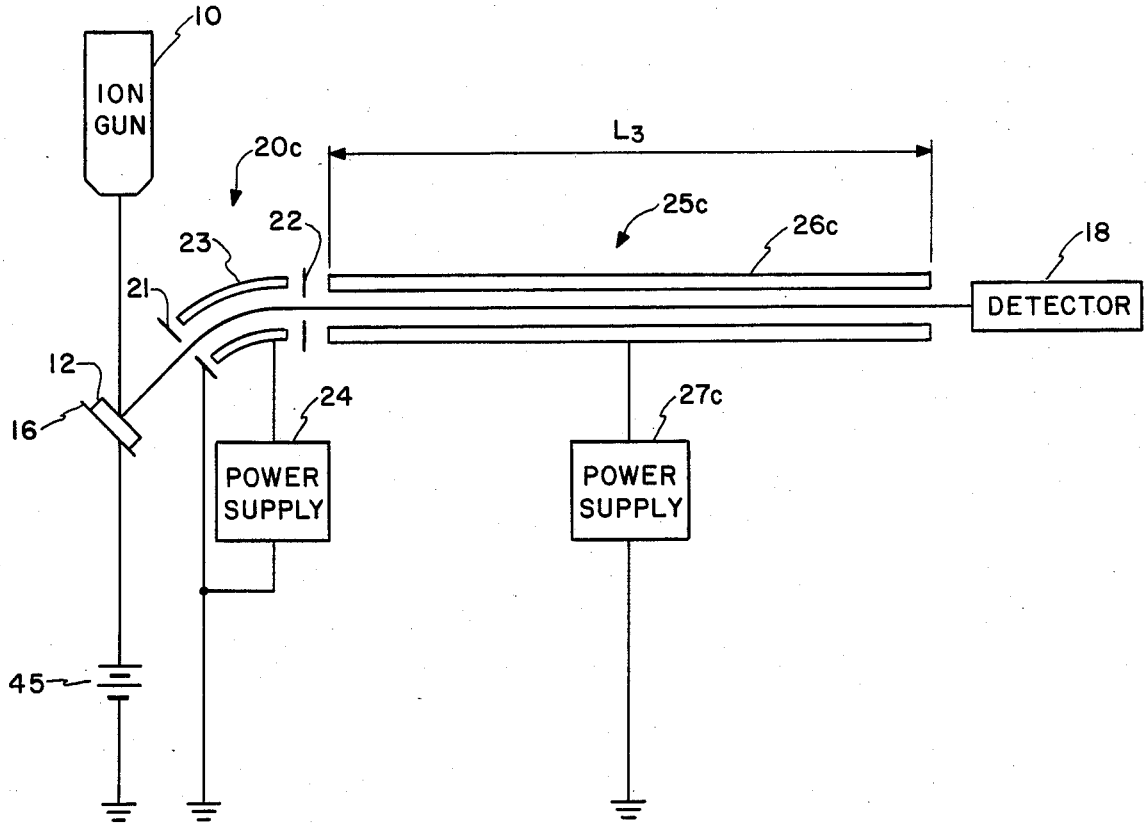
FIG. 7 is a block diagram, like FIG. 3, of a mass spectrometer according to a third embodiment of this invention.

Referring to FIG. 7, a mass spectrometer according to a third embodiment of this invention is similar to that illustrated in FIG. 6 except that the holder 16 is supplied with a holder electric potential of 400 volts from a modified d.c. power supply 45 and that a quadrupole mass filter 25c comprises four electrode members 26c, each of which has a length $L_3$ equal to three times the length $L_0$ of each electrode 26 illustrated in FIG. 1 and which is supplied from a power supply 27c with the a.c. voltage of a frequency of 3 MHz. The frequency of 3 MHz is equal to 1.67 times the frequency $f_0$=1.8 MHz applied to the conventional electrodes 26 of FIG. 1. The illustrated mass spectrometer also has an analyzable energy range between −100 eV and +100 eV.

In the example being illustrated, the energy filter 20 has a resolution of 0.5 and a transmission energy of 400 eV. The transmission band is thus between 300 and 500 eV and the transmission bandwidth is equal to 200 eV. The ion orbiting path of the energy filter 20 is kept at the ground potential.

Let the object 12 be bombarded by the ion beam emitted from the ion gun 10. As mentioned before, the holder 16 is kept at the holder electric potential of 400 volts which has the same polarity as the ion beam. Under the circumstances, the object 12 emits the secondary ions given a potential energy of 400 eV by the modified d.c. power supply 45. The energy filter 20 allows the secondary ions to pass therethrough when the energy value of the secondary ions is varied between 300 and 500 eV relative to ground due to the fact that the surface electric potential of the object 12 relative to the 400 holder 16 fluctuates between −100 and +100 volts.

The illustrated mass filter 25c has a maximum analyzable value of 500 eV which is equal to twenty-five times that of the conventional mass filter 25 illustrated in FIG. 1, as readily understood from Equation (1). The center potential at the center of the mass filter 25c is kept at the ground potential. Thus, the mass filter 25c can analyze the secondary ions sent from the energy filter 20.

With this structure, it is unnecessary to raise up the resolution and to impress an electric potential on both of the ion orbiting path of the energy filter 20 and the center of the mass filter 25c.

While the present invention has thus far been described in conjunction with two embodiments thereof, it will readily be possible for those skilled in the art to put this invention into practice in various other manners. For example, the holder electric potential and the electric potential on the entrance electrode 21 may be selected in consideration of resolution of the energy filter so that the transmissible bandwidth becomes equal to at least twice the specific energy bandwidth. The length of the four electrodes, the frequency of the a.c. voltage, and the center electric potential may be selected in consideration of the transmissible bandwidth. The transmissible band of the energy filter and the mass analyzable range of the quadrupole mass filter may not necessarily coincide with each other, if a narrower one of the above-mentioned band and range covers at least twice the energy bandwidth. The energy filter may be of any electrostatic deflection type, such as a parallel flat type, a cylindrical type, a hemisphere type, or a cylindrical mirror type. The energy filter may be placed between the quadrupole mass filter and the detector. The energy filter may be replaced by displacing the detector from the center axis of the quadrupole mass filter. In this event, the mass spectrometer is very simple in structure. If restrictions are imposed on the polarity of the irradiation ions and the like so that the surface electric potential is varied either to a positive direction or to a negative direction, the exemplified analyzable energy range may be reduced to a half thereof.

What is claimed is:

1. A secondary ion mass spectrometer comprising an ion gun for radiating an ion beam onto a surface of an object to make said surface emit secondary ions with an energy distribution having a peak and a specific energy bandwidth which is predetermined with reference to said peak, a detector for ions, and directing means for directing the secondary ions of an analyzable energy range to said detector, said analyzable energy range being predetermined in consideration of said specific energy bandwidth, said directing means comprising a combination of an energy filter and a quadrupole mass filter, wherein the improvement comprises expanding means coupled to said directing means for expanding said analyzable energy range to a wider range which is equal to at least twice said specific energy bandwidth.

2. A mass spectrometer as claimed in claim 1, wherein said energy filter has a transmissible bandwidth for filtering the secondary ions of said transmissible bandwidth into transmitted ions, and wherein said expanding means comprises transmissible bandwidth spreading means coupled to said energy filter for spreading said transmissible bandwidth to expand said analyzable energy range to said wider range.

3. A mass spectrometer as claimed in claim 2, wherein said transmissible bandwidth is spread to at least 40 electron volts.

4. A mass spectrometer as claimed in claim 2, said energy filter defining an ion orbiting path kept at a predetermined electric potential to guide said secondary ions therealong, said object being held by a holder kept at a holder electric potential, wherein said predetermined electric potential and said holder electric potential have a potential difference which is equal to at least 40 volts.

5. A mass spectrometer as claimed in claim 2, wherein said quadrupole mass filter is coupled to said energy filter and has a maximum energy value related to said transmissible bandwidth and to which said quadrupole mass filter can analyze said transmitted ions, wherein said expanding means further comprises modifying means coupled to said quadrupole mass filter and said transmissible bandwidth spreading means for modifying said maximum energy value in consideration of the transmissible bandwidth spread by said transmissible bandwidth spreading means.

6. A mass spectrometer as claimed in claim 5, wherein said modifying means comprises raising means for raising said maximum energy value in comparison with the transmissible bandwidth spread by said transmissible bandwidth spreading means.

7. A mass spectrometer as claimed in claim 5, said quadrupole mass filter having a center axis along which said transmitted ions are directed towards said detector and comprising four electrode members azumuthally spaced apart from one another concentrically around said center axis, wherein said modifying means comprises potential means coupled to said four electrode members for putting said four electrode members into an electric potential at which said transmitted ions are analyzable in the transmissible bandwidth spread by said transmissible bandwidth spreading means.

8. A mass spectrometer as claimed in claim 7, said potential means having a first terminal connected to said four electrode members, a second terminal grounded, and voltage supply means for supplying an electric voltage to said four electrode members to keep said four electrode members at said electric potential relative to said second terminal, wherein said center axis being kept at a center potential which is not lower than 40 volts relative to said second terminal.

9. A mass spectrometer as claimed in claim 7, wherein said transmitted ions are decelerated during travel along said center axis.

10. A mass spectrometer as claimed in claim 5, said quadrupole mass filter having a center axis along which said transmitted ions are directed towards said detector and which is kept at a center potential while said object is held by a holder kept at a holder potential, wherein said center and said holder potentials have a potential difference which is not lower than 40 volts.

11. A mass spectrometer as claimed in claim 1, said quadrupole mass filter having a center axis for guiding said transmitted ions, four electrode members azimuthally spaced apart from one another concentrically around said center axis, and power supply means for supplying each of said four electrodes with superposition of a d.c. voltage and an a.c. voltage of frequency f, wherein said expanding means comprises four additional electrodes successively extended along said center axis between said four electrodes and said detector and connected to said power supply means in common to said four electrodes.

12. A mass spectrometer as claimed in claim 11, wherein a combination of each of said four electrodes and each additional electrode has a length L, said length L and said frequency f having a relationship which is given by:

$$L^2 \cdot f^2 \geqq 0.4$$

where L and f are represented by meter and megahertz, respectively.

* * * * *